US005204665A

United States Patent [19]

Bollman et al.

[11] Patent Number: 5,204,665

[45] Date of Patent: Apr. 20, 1993

[54] COLOR EDITING WITH SIMPLE ENCODED IMAGES

[75] Inventors: James E. Bollman, Williamson, N.Y.; Myra E. Van Inwegen, Philadelphia, Pa.

[73] Assignee: Xerox Corporation, Stamford, Conn.

[21] Appl. No.: 805,358

[22] Filed: Dec. 9, 1991

Related U.S. Application Data

[63] Continuation of Ser. No. 517,895, May 2, 1990, abandoned.

[51] Int. Cl.[5] ..... G09G 1/28

[52] U.S. Cl. ..... 340/703; 340/701; 358/80

[58] Field of Search ..... 340/701, 703, 793; 358/31, 75, 80

[56] References Cited

U.S. PATENT DOCUMENTS

| | | | |
|---|---|---|---|
| 4,564,915 | 1/1986 | Evans et al. | 364/521 |
| 4,654,720 | 3/1987 | Tozawa | 340/703 |
| 4,694,286 | 9/1987 | Bergstedt | 340/703 |
| 4,725,828 | 2/1988 | Cowlishaw | 340/703 |
| 4,727,425 | 2/1988 | Mayne et al. | 358/80 |
| 4,733,230 | 3/1988 | Kurihara et al. | 340/703 |
| 4,739,313 | 4/1988 | Oudshoorn et al. | 340/703 |
| 4,974,070 | 11/1990 | Hock et al. | 358/86 |

OTHER PUBLICATIONS

Floyd et al "An Adaptive Algorithm for Spatial Grayscale", pp. 75–77, 1976.

*Primary Examiner*—Ulysses Weldon
*Assistant Examiner*—Regina Liang
*Attorney, Agent, or Firm*—Mark Costello

[57] ABSTRACT

In an original image in red, green, blue color space (RGB) defined by a large number of colors, color variety of the original image is accomplished by displaying a reduced representative color set. The reduced representative color set is produced by initially treating each color separation individually, to reduce the number of levels defining the image, in a manner which retains much of the image information. Subsequently, the separations are combined into an index into color set in a look up table (LUT) having between about 27 and 120 RGB triplets. Each RGB triplet defined by one of the LUT triplets is converted to a luminance/chrominance value. Modifications are made to the image in luminance/chrominance, and converted back to RGB space to reload the LUT for real time color variation of the image. Upon establishing a desirable color set in luminance/chrominance space, the luminance/chrominance values selected, which define the new position of the image in luminance/chrominance space, are used to change the colors in the original in a single step. The new original image is then again displayed with a new reduced representative color set derived in the same manner as described.

21 Claims, 3 Drawing Sheets

COLOR EDITING WITH SIMPLE ENCODED IMAGES

This is a continuation of application Ser. No. 07/517,895, filed May 2, 1990 is now abandoned.

The present invention relates generally to color imaging and more particularly to real time color editing of images with a reduced color set.

CROSS REFERENCE

Cross reference is made to U.S. patent application Ser. No. 07/404,395 by Venable et al., entitled "Color Set Selection and Color Imaging", assigned to the same assignee as the present application.

BACKGROUND OF THE INVENTION

For high quality, high density color displays, colors are generally stored as 24 bit values, with red, green and blue separations. Each separation $N_x$ is typically an 8 bit value, so that the color of each pixel is identified as a value in the range of 0–255 for each separation that forms the image. For example, a value of 0 for the red separation means that there is no red in the pixel, while a value of 255 means that the pixel has fullest amount of red it may have. In a 24 bit/pixel color system there are $(256)^3$ or approximately 16 million possibilities of color for each pixel in a color image.

It is often desirable to alter or vary color in luminance/chrominance space. However, with 16 million possibilites of color in RGB space for each pixel, where each pixel in the image would require conversion to a luminance/chrominance value, real time editing of the image on a display presents significant difficulties. Another approach would be to a very high speed computer, but this approach is not economically desirable. Additionally, while the image is usually displayed in RGB color space, modification of RGB images with direct control of each separation is not intuitive to the casual user of such a system.

U.S. patent application Ser. No. 07/404,395 by Venable et al., entitled "Color Set Selection and Color Imaging", teaches a method of selecting an optimum color set for such color imaging system, while maintaining the impression of full color.

U.S. Pat. No. 4,725,828 to Cowlinshaw shows a method of displaying and coding a color image wherein a number of levels are provided to encode the image using error diffusion. The proportions of red, green and blue in each pixel are varied by bit boundaries dependent on eye sensitivity. U.S. Pat. No. 4,564,915 to Evans et al. discloses a chrominance/luminance computer color graphics system, wherein a frame buffer is used to store color images, and a conversion matrix is provided to convert between RGB and chrominance/luminance color space. U.S. Pat. No. 4,739,313 to Oudshoorn et al. discloses a multilevel grey scale or composite video to RGBI decoder wherein 6 levels are used to define a gray scale as well as a RGBI space. U.S. Pat. No. 4,727,425 to Mayne et al. discloses a color modification table for use in image reproduction systems, where tables are provided for four color components. U.S. Pat. No. 4,694,286 to Bergstedt shows an on-screen user interface for altering hue, lightness, and saturation values for any pixel.

All the references cited hereinabove are specifically incorporated by reference.

SUMMARY OF THE INVENTION

The present invention is directed to an arrangement which uses a highly reduced, but representative set of colors, for display of an original image having a large number of colors, at a user interface during the selection of a color set, to allow real time color variations, with the variations subsequently applied to the original image.

In accordance with one aspect of the invention, in an original image in red, green, blue color space (RGB) defined by a large number of colors, color variation of the original image is accomplished via modification of a reduced approximation color set. The reduced color set is produced by initially treating each color separation individually, to reduce the number of levels defining the image, in a manner which retains much of the image information, with each separation R, G and B retaining a number of levels $N_x$ such that $N_R \times N_G \times N_B$ is in the ranage of about 27 to 120. Subsequently, the separations are combined into an array of numbers which map to a color set having between about 27 and 120 RGB triplets. Thus, an approximation of the original image may be displayed, with one of the RGB triplets defining each pixel in the original image. Each LUT triplet, and by consequence the pixels it defines, is coverted to a luminance/chrominance value, for real time color variation of the image. Modifications are made in luminance/chrominance space, and immediately converted back to RGB space, and the LUT reloaded for display. This changes the appearance of the image on the display. Upon establishing a desirable color set in luminance/chrominance space, the luminance/chrominance values selected, which define the new position of the image in luminance/chrominance space, are used to change the colors in the original image in a single step. The new image is then again displayed with the reduced approximation color set derived in the same manner as described.

In accordance with another aspect of the invention, a look up table may be generated having standard color, set values and modified color set values, so that images on the display may be displayed in either the standard color set, or the modified color set.

In accordance with yet another aspect of the invention, a user interface is provided for real time color variation of the image in luminance/chrominance color space, which provides simple controls that simulate television color controls.

These and other aspects of the invention will become apparent from the following description used to illustrate a preferred embodiment of the invention read in conjunction with the accompanying drawings in which.

Figure 1:
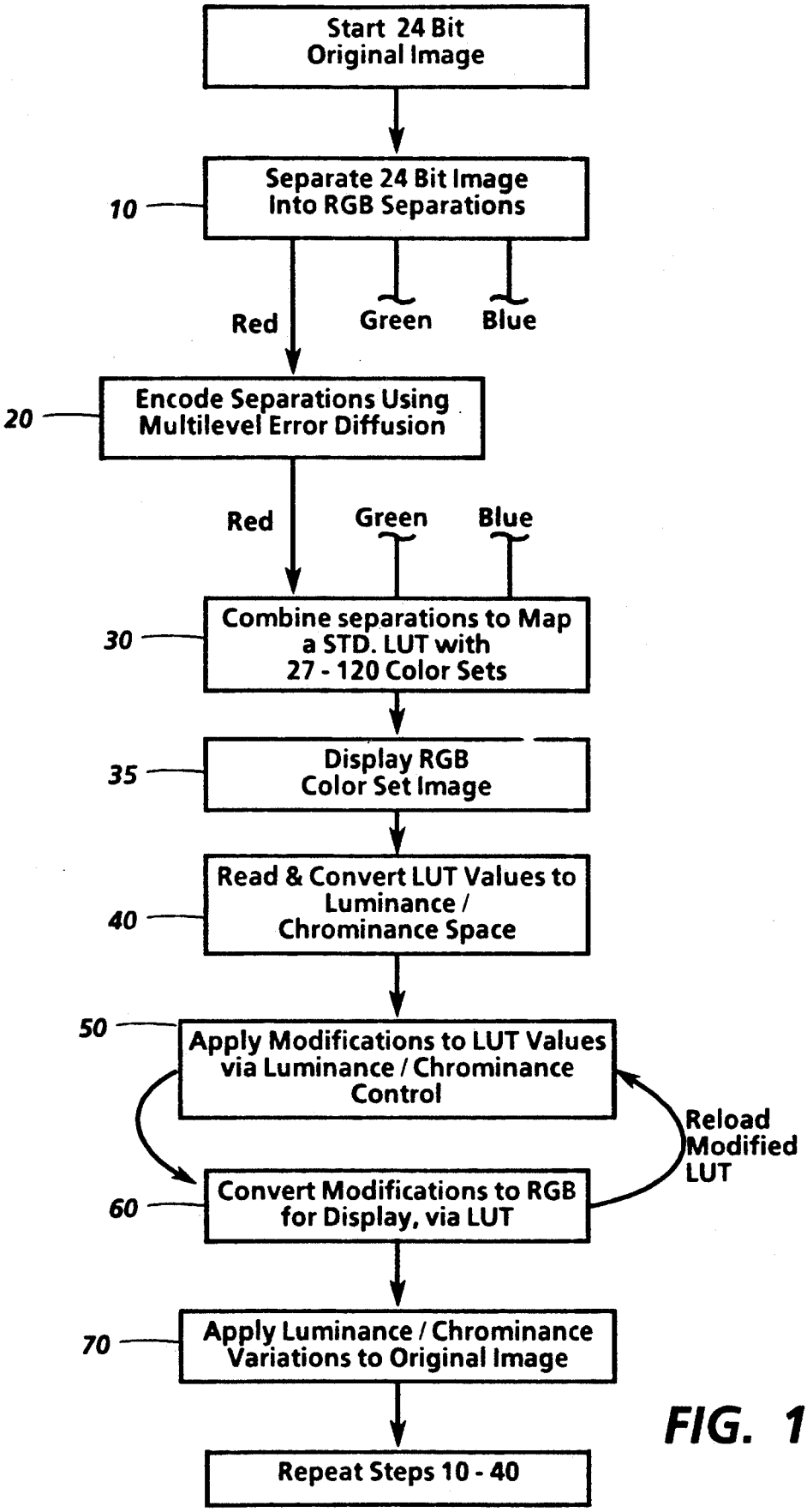
FIG. 1 shows a step-by-step flow chart of the creation of the reduced color set from the original image, and subsequent variation of the color.

With reference now to the drawings where the showings are for the purpose of illustrating an embodiment of the invention and not for the purpose of limiting same, FIG. 1 shows a flow chart of the inventive process that will be referred to in describing the invention.

High quality, high density CRT displays reproduce color images in red, green and blue components. Each pixel in the color image, produced in accordance with several known processes, may be defined with a 24 bit value, which provides three color separations, each represented by an 8 bit value. Accordingly, the color set or palette available for use in such displays has about 16 million colors. In the embodiment described, a Sun workstation having 8 bit deep graphics, with a Unix operating system was used for color modification of images. Sun workstations are the product of Sun Microsystems, Inc. of Sunnyvale, CA. The workstations used in the development of the described invention may be characterized as personal minicomputers, with multitasking operations. User data entry at the workstation is typically provided through a keyboard and a mouse. Of course, such features are not required, and other processors and data entry devices are possible. The graphics display used was a standard Sun Microsystems 1152×900, 8 bit deep display. Programs implementing the described invention were produced in the "C" language. The user interface that will be further described hereinbelow was produced using the X-Windowing System software, from the Massachusetts Institute of Technology, Cambridge, MA. A similar user interface development tool is the Sun X-News software, a proprietary software of Sun Microsystems, Inc. Of course, other graphics display systems, and other software may be used to the same effect as those used to produce the present invention. Another suitable device for implementing the present invention might be one of the Macintosh II family of products, produced by Apple Corporation of Cupertino, CA.

At a first step 10 to producing an approximation or representative reduced number color set, each separation is handled separately from its complements. Using the red separation, labeled RED, as an example, the intensity value, typically an 8 bit value providing up to 256 levels of intensity, is encoded at a step 20 to a much smaller value between about 3 levels and 8 levels of intensity. The number of levels chosen for each separation now represent the full range of each color, albeit with more widely spaced intervals. The number of levels retained is selected based upon experimentation to determine a number of levels that produce an esthetically pleasing reduced color set for display purposes. It is, of course, important that the reduced color set to be produced have an appearance close to the original image, or color modification will have no value. Since a simple threshold application, which could be used, will produce undesirable image artifacts, a conversion which smoothes the image across levels of conversion is desirable. Several well known dithering and/or error conversion methods are known for this purpose. The well-known Floyd-Steinberg Error Diffusion Algorithm (1976), or one of many derivative error diffusion methods, is one way to distribute the difference error derived in the encoding arrangement over adjacent pixels for image smoothing. One such derivative technique is described in U.S. patent application Ser. No. 07/404,395 by Venable et al., entitled "Color Set Selection and Color Imaging". It has been determined that the number of levels $N_X$, of each color for a set which suitably approximates the original color image is approximately 4 red levels ($N_R$), 8 green levels ($N_G$), 3 blue levels ($N_B$). There are a number of other combinations, including 5 red levels, 5 green levels, 4 blue levels, or 5 red levels, 6 green levels, 3 blue levels. Other schemes are possible and depend for their desirability on the user's perception of the color accuracy of such approximations.

In step 30, the new color values of the color separations are combined to produce a single number for each pixel, that indicates one of the RGB triplets possible in the index of the reduced color set. Using the set of 4 red levels, 8 green levels, 3 blue levels, derives a total of 96 color levels or triplets ($N_R \times N_B \times N_G$). Thus, each pixel in the original image having 16 million colors is represented by one of these triplets, by mapping through the LUT, through the index of numbers indicating the reduced color set. The color index is created by taking combinations of the amounts of red represented by $N_R$ levels of red, the amounts of green represented by $N_G$ levels of green, and the amounts of blue represented by $N_B$ levels of blue. Together, the 96 levels or triplets will be referred to as the "standard color look up table". Esthetically, it has been determined that a limited number of color levels, in the range of 27–120 levels, serves as an adequate representation of the original color image. Particularly satisfactory results are found in the range of about 90 to 100 levels. The lowest number of levels usable depends somewhat on user perception, but also on the resolution of the display. On a relatively high resolution display, the problem of noise created through the use of the error diffusion or thresholding algorithms is minimized. Obviously, control of color rendition that will ultimately be applied to the original image is not as fine as with a larger number of levels, but for many purposes, the lower number of levels may suffice. The highest number of levels is preferably selected as 120, although a higher number of levels, up to 256 levels, may be used in accordance with the invention, if two look up tables in a 256 level mapping are not desired. Similarly, if a ten bit graphics system is used, the limit would be 1024 levels. Beyond about a 16 bit graphics system, however, the advantage of the invention is lost in the increased computational time.

Figure 2:
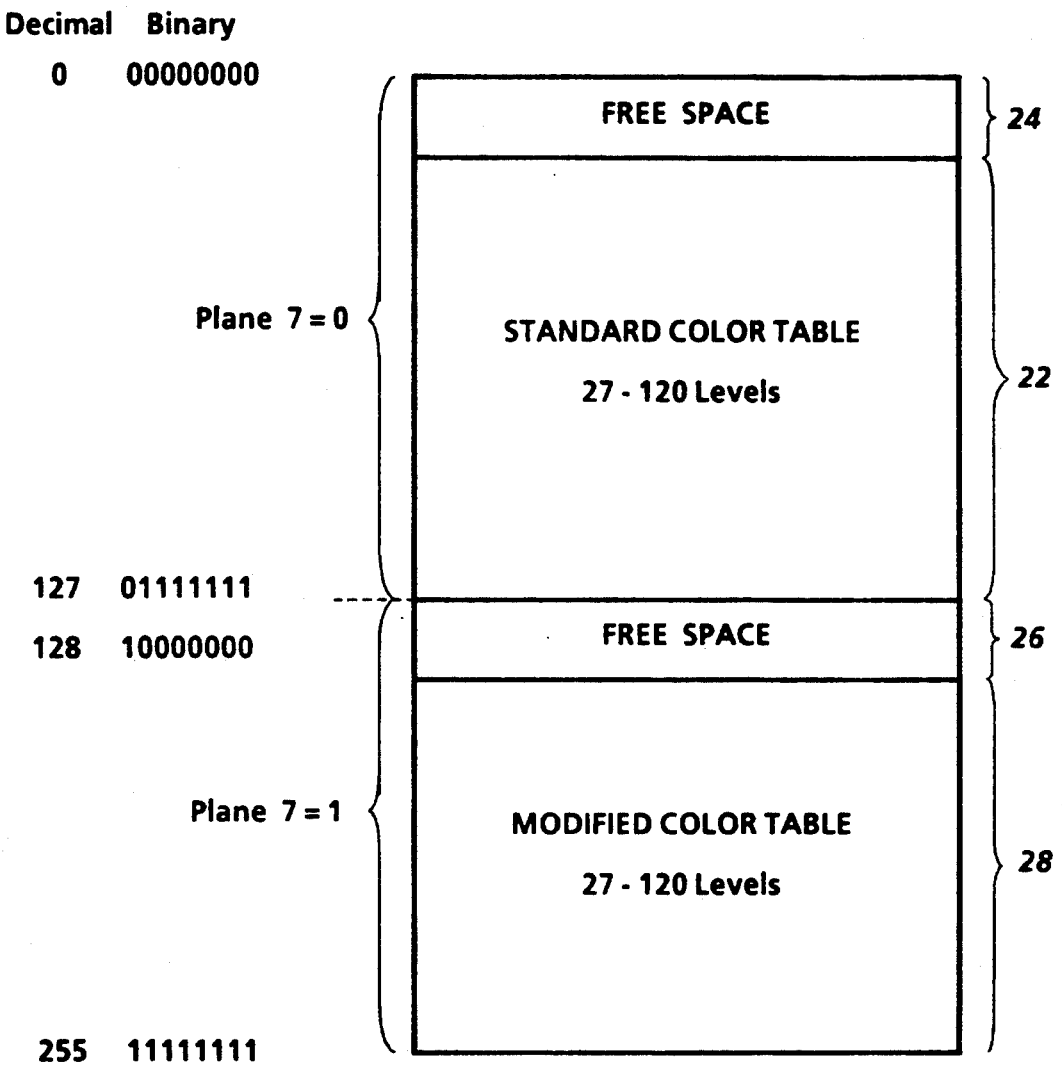
FIG. 2 shows the memory mapping of the color set in an 8 bit system which allows a standard color set and modified color set to exist on a single display.

As shown in FIG. 2, color tables are stored in a 256 level look up table in the described 8 bit graphics system, with the mapping of FIG. 2, where the standard color table is stored in a portion 22 of register 23. Portions 24 and 26 are free space for colors that are unique to other display applications. Portion 28 is a modified color table, that will be explained hereinafter. If more than 128 levels are desired for color modification, there may be room for only a single LUT. Two look up tables are desirable so that other images or portions of the image being modified on the display, may be mapped to a standard color LUT, and are not modified simultaneously with the subject image.

In step 40, manipulation of colors of the original image begins with the conversion of the RGB color LUT to luminance/chrominance values, representative of the position of the standard RGB color set in luminance/chrominance space. The luminance/chrominance conversion or space used is not limited to any particular selection, and may be the well-known YIQ, space, or the less well known Xerox YES or LAB space. The relative position of the color set in luminance/chrominance space may be reflected in a user interface I within a window arrangement, similar to that shown in FIG. 3, where, below the image display space 41, are sliders 42, 43, 44 and 45, respectively representing hue, saturation, black and white contrast and brightness. Hue and saturation represent chrominance values, and variations of hue and saturation vary the actual color of the image. Black and white contrast and brightness represent luminance values, and variations of black and white contrast and brightness represent variations in the intensity of the image.

At steps 50, and as described, modification of the color image occurs in a manner similar to that of a color television set, which most users are familiar with. It has been qualitatively determined that an initial step to obtaining good color rendition is to turn off the color completely (saturation control), and work at obtaining an optimum black and white image, and subsequently adding color as desired. The user interface I, and image manipulation in luminance/chrominance space allows this technique. Additional controls, 46, 47, 48, respectively labeled "Original", "Cancel", and "Apply", represent functions for the application of color modifications to the image, where "Original" toggles the displayed image between the original color LUT and the modified color LUT, "Cancel" cancels or nullifies any changes made to the displayed image to return to the appearance of the original, as defined by the standard color LUT, and "Apply" actually applies the changes specified by the sliders to the image, as will be explained hereinafter. In a possible arrangement, the sliders or "gauges" 49 are selectable and dragged to appropriate positions with a mouse-driven cursor (not shown), while the additional controls are areas for selection by the mouse-driven cursor for activation of those functions. Of course, the displayed controls might be on a touch screen, activatable by user touch.

Figure 3:
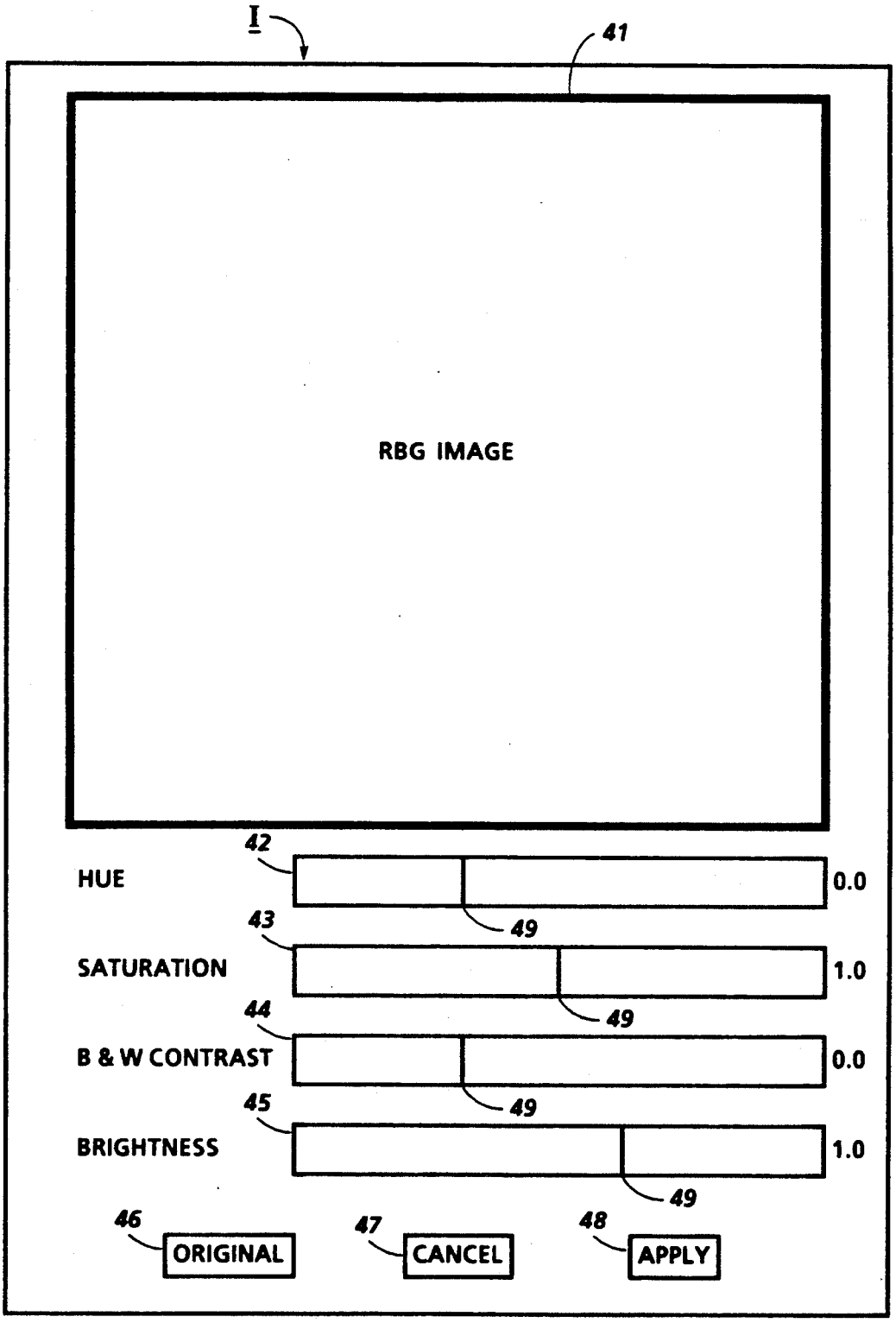
FIG. 3 shows a user interface usable in association with the described invention.

At step 60, and with reference again to the memory mapping of FIG. 2, variations to the image LUT in luminance/chrominance space are converted directly back to RGB space, to modify the color set in the standard color table 22, and thereby create a new color set in the modified color table 28. In turn, the new RGB triplets defined as a result of the conversion are displayed to reflect the changes. Since only a small number of values (27–120) are being changed, the modification made at the user interface I of FIG. 3 are applied to the displayed image in essentially real time.

At step 70, once a desired color modification is derived, the luminance/chrominance equations that define the relative position of the image in luminance/chrominance space with respect to its original position are stored and applied to the original image. This operation is not expected to occur in real time, and may be referred to a high speed computer on a network for processing. Alternatively, and because the user expects the delay and can select the time of its occurrence, the user's processor on the user's own workstation may apply the luminance/chrominance equations to the 24 bit/pixel data.

At step 80, and with reference to FIG. 1 the newly modified 24 bit/pixel data is again displayed on the workstation, in the reduced color set mode. The image displayed may vary slightly from the image as modified, since many imaging artifacts that appear on the screen during modification are removed when the underlying original image is changed.

It will of course be appreciated that when speaking about an "image", the reference is to that portion of an entire image for which modification is desired. Accordingly, the color of an entire image may be varied, or the color of only a user defined portion of the image might be varied, through standard area definition methods.

In a manner similar to that described, gray scale images can take advantage of the reduction in levels during modification to speed up the modification processing itself, and to fit in the same 256 level LUT with the color image. Accordingly, gray scale images, often derived in 256 levels, may be reduced to as few as 16 levels, modified in luminance space, with the modifications subsequently applied to the image. As an interesting adjunct to this embodiment, on a display capable of displaying the full 256 gray scale image, subsequent to gross modification of the image, the image can be displayed in 256 levels, for fine modification, encoding to a greater number of levels, up to the ability of the display, for a finer adjustment, in a "proof mode". The above is also true in color operations, where the colors may be encoded to more levels for better control when needed, up to the ability of the display.

Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

We claim:

1. A method of modifying color in an n-bit system, wherein a digitally encoded representation of an original image in red-green-blue color space, the original image composed of pixels defined by the level of red, green and blue therein, each pixel defined by one of a number of encoded values of levels of red, green and blue, such number relatively large with respect to a desired number of levels for modifying the color of the original image, comprising the steps of:

a) separating the original image into red, green and blue color separations, whereby for each separation, each pixel in the original image is defined by one of N different levels of red or green or blue at that pixel position;

b) for each of the red, green and blue color separations, reducing the number of levels N defining pixels in each separation, to a value $N_R$, $N_B$, and $N_G$, respectively, where $N_R \times N_B \times N_G$ is less than $2^n$;

c) producing a look up table having a number of entries equal to $N_R \times N_B \times N_G$, each entry of the look up table consisting of one RGB triplet;

d) combining the reduced number of levels $N_R$, $N_B$, and $N_G$ together to form an index for each pixel for which an RGB triplet in the look up table is selected;

e) displaying the original image in terms of the reduced number of levels $N_R$, $N_B$, and $N_G$ on a display device;

f) converting each RGB triplet in the look up table to a set of luminance and chrominance values, whereby each pixel identified as an RGB triplet is defined by a set of luminance and chrominance values;

g) modifying the of each RGB triplet in the look up table, whereby each pixel identified as an RGB triplet is identified as a modified RGB triplet, whereby the overall appearance of the image is changed; and h) modifying each pixel of the original image defined by one of a relatively large number of encoded values of levels of red, green and blue, in accordance with the modifications to the set of luminance and chrominance values of each combination of $N_R$, $N_B$, and $N_G$ in the look up table.

2. The method as defined in claim 1, wherein the relatively large number of encoded values of levels of red, green and blue, is approximately $(256)^3$.

3. The method as defined in claim 1, wherein the number of levels N defining pixels in each separation is 256.

4. The method as defined in claim 1, wherein the number n is equal to 8.

5. The method as defined in claim 4, wherein $N_R$, $N_B$, and $N_G$, are not necessarily equal, and $3 \leqq N_R$, $N_B$, or $N_G \leqq 8$.

6. The method as defined in claim 4, wherein for an $N_x$ of the group $N_R$, $N_B$, and $N_G$, $3 \leqq N_x \leqq 8$.

7. The method as defined in claim 4, wherein $27 \leqq N_R \times N_B \times N_G \leqq 120$.

8. The method as defined in claim 4, wherein $N_R \times N_B \times N_G$ is between 90 and 100.

9. The method as defined in claim 4, wherein $N_R \times N_B \times N_G$ equals 96.

10. The method as defined in claim 1 wherein the step of reducing the number of levels N defining pixels in each separation, to the reduced number of levels $N_R$, $N_B$, and $N_G$, respectively, where $N_R \times N_B \times N_G \leqq 2^n$, uses error diffusion among neighboring pixels to smooth artifacts arising from the reduction in levels from N to $N_R$, $N_B$, or $N_G$.

11. A method of modifying color in a digitally encoded representation of an original image in red-green-blue color space, the original image composed of pixels defined by the level of red, green and blue therein, each pixel defined by one of a number of encoded values of levels of red, green and blue, such number relatively large with respect to a desired number of levels for modifying the color of the original image, the modifications to be performed on a digital computer, with a processor, a display, a display memory suitable for storing a set of values defining pixels in each separation representing 256 colors, and data entry arrangement, comprising the steps of:

a) at the processor, separating the original image into red, green and blue color separations, whereby for each separation, each pixel in the original image is defined by one of N different values of red or green or blue at that pixel position;

b) at the processor, for each of the red, green and blue color separations, reducing the number of values N defining pixels in each separation, to a value $N_R$, $N_B$, and $N_G$, respectively, where $27 \leqq N_R \times N_B \times N_G \leqq 120$;

c) in the display memory, producing a look up table having a number of entries equal to $N_R \times N_B \times N_G$, each entry of the look up table consisting of one RGB triplet;

d) in the processor, combining the reduced number of levels together to form an index for each pixel for which an RGB triplet is selected from the reduced color set;

e) at the display, displaying the original image in terms of the reduced number of levels $N_R$, $N_B$, and $N_G$;

f) with the processor, converting each RGB triplet in the look up table in the display memory to a set of luminance and chrominance values, whereby each pixel identified as an RGB triplet is defined by a set of luminance and chrominance values;

g) with the data entry arrangement, entering modifications, to the set of luminance and chrominance values of each combination of $N_R$, $N_B$, and $N_G$ in the look up table, whereby each pixel identified as a combination of $N_R$, $N_B$, and $N_G$ is also modified, and entering the modifications into the look up table in the display memory, whereby the overall appearance of the displayed image is changed; and h) modifying each pixel of the original image defined by one of a relatively large number of encoded values of levels of red, green and blue, in accordance with the modifications to the set of luminance and chrominance values of each combination of $N_R$, $N_B$, and $N_G$ in the look up table.

12. The method as defined in claim 11, wherein the relatively large number of encoded values of levels of red, green and blue, is approximately $(256)^3$.

13. The method as defined in claim 11, wherein the number of levels defining pixels in each separation is 256.

14. The method as defined in claim 11, wherein $N_R$, $N_B$, and $N_G$, are not necessarily equal, and $3 \leqq N_R$, $N_B$, or $N_G \leqq 8$.

15. The method as defined in claim 11, wherein for each N of $N_R$, $N_B$, and $N_G$, $3 \leqq N \leqq 8$.

16. The method as defined in claim 11, wherein $N_R \times N_B \times N_G$ is between 90 and 100.

17. The method as defined in claim 16, including the step of:

displaying the modified original image, on the display device, by repeating steps a–d, for the modified original image.

18. The method as defined in claim 11, wherein $N_R \times N_B \times N_G$ equals 96.

19. The method as defined in claim 11 wherein the step of reducing the number of levels N defining pixels in each separation, to $N_R$, $N_B$, and $N_G$, respectively, where $27 < N_R \times N_B \times N_G < 120$, uses error diffusion among neighboring pixels to smooth artifacts arising from the reduction in levels from N to $N_R$, $N_B$, or $N_G$.

20. The method as defined in claim 11, including the step of:

with the processor, modifying each pixel of the original image defined by one of the relatively large number of encoded values of levels of red, green and blue, in accordance with the modifications to the set of luminance and chrominance values of each combination of $N_R$, $N_B$, and $N_G$ in the look up table in the display memory.

21. A method of modifying color in a digitally encoded representation of an original image in red-green-blue color space, the original image composed of pixels defined by the level of red, green and blue therein, each pixel defined by one of a number of encoded values of levels of red, green and blue, such number relatively large with respect to a desired number of levels for modifying the color of the original image, the modifications to be performed on a digital computer, with a processor, a display, a display memory suitable for storing a set of values representing 256 colors, and data entry arrangement, comprising the steps of:

a) at the processor, separating the original image into red, green and blue color separations, whereby for each separation, each pixel in the original image is defined by one of N different values of red or green or blue at that pixel position;

b) at the processor, for each of the red, green and blue color separations, reducing the number of values N defining pixels in each separation, to a value $N_R$, $N_B$, and $N_G$, respectively, where $27 \leqq N_R \times N_B \times N_G \leqq 120$;

c) in the display memory, producing a look up table having a number of entries equal to $N_R \times N_B \times N_G$, each entry of the look up table consisting of one RGB triplet;

d) in the processor, combining the reduced number of levels together to form an index for each pixel for which an RGB triplet is selected from the reduced color set;

e) at the display, displaying the original image in terms of the reduced number of levels $N_R$, $N_B$, and $N_G$;

f) with the processor, converting each RGB triplet in the look up table in the display memory to a set of luminance and chrominance values, whereby each pixel identified as an RGB triplet is defined by a set of luminance and chrominance values;

g) with the data entry arrangement, selecting a portion of the image;

h) in the display memory, producing a look up table having a number of entries equal to $N_R \times N_B \times N_G$ for the selected area, each entry of the look up table consisting of one RGB triplet;

i) in the processor, combining the reduced number of levels together to form an index for each pixel in the selected area for which an RGB triplet is selected from the reduced color set;

j) with the data entry arrangement, entering modifications to the set of luminance and chrominance values of each combination of $N_R$, $N_B$, and $N_G$ in the second look up table, whereby each pixel in the selected area identified as a combination of $N_R$, $N_B$, and $N_G$ is also modified, and entering the modifications into the look up table in the display memory, whereby the appearance of the selected area of the displayed image is changed;

k) modifying each pixel of the original image defined by one of a relatively large number of encoded values of levels of red, green and blue, in accordance with the modifications, if any, to the set of luminance and chrominance values of each combination of $N_R$, $N_B$, and $N_G$ in the look up table.

* * * * *